US007490028B2

(12) United States Patent
Sayers et al.

(10) Patent No.: US 7,490,028 B2
(45) Date of Patent: Feb. 10, 2009

(54) METHOD, APPARATUS AND SYSTEM FOR PORE PRESSURE PREDICTION IN PRESENCE OF DIPPING FORMATIONS

(76) Inventors: Colin M Sayers, 5599 San Felipe, Suite 1700, Houston, TX (US) 77056; Sudhendu Kashikar, 5599 San Felipe, Suite 1700, Houston, TX (US) 77056; Patrick J. Hooyman, 5599 San Felipe, Suite 1700, Houston, TX (US) 77056

( * ) Notice: Subject to any disclaimer, the term of this patent is extended or adjusted under 35 U.S.C. 154(b) by 512 days.

(21) Appl. No.: 10/426,352

(22) Filed: Apr. 10, 2003

(65) Prior Publication Data

US 2004/0244972 A1 Dec. 9, 2004

Related U.S. Application Data

(60) Provisional application No. 60/371,541, filed on Apr. 10, 2002.

(51) Int. Cl.
*G06G 7/48* (2006.01)

(52) U.S. Cl. ..... 703/10; 166/255.1; 166/280.1; 166/66; 166/281; 166/60

(58) Field of Classification Search ..... 175/61, 175/45, 25, 39; 702/6, 14, 12; 73/152.05, 73/152.31, 152.03; 166/60; 367/73; 703/2, 703/10

See application file for complete search history.

(56) References Cited

U.S. PATENT DOCUMENTS 4,791,998 A * 12/1988 Hempkins et al. ..... 175/61
4,817,062 A * 3/1989 De Buyl et al. ..... 367/73
4,821,564 A * 4/1989 Pearson et al. ..... 73/152.31
4,833,914 A * 5/1989 Rasmus ..... 73/152.03
4,981,037 A * 1/1991 Holbrook et al. ..... 73/152.05
5,220,504 A * 6/1993 Holzhausen et al. ..... 702/12
5,305,836 A * 4/1994 Holbrook et al. ..... 175/39
5,813,463 A * 9/1998 Stadulis ..... 166/280.1
5,965,810 A * 10/1999 Holbrook ..... 73/152.05
6,101,447 A * 8/2000 Poe, Jr. ..... 702/13
6,109,368 A * 8/2000 Goldman et al. ..... 175/39
6,220,087 B1 4/2001 Hache et al. ..... 73/152.46
6,351,991 B1 3/2002 Sinha ..... 73/152.01
6,408,953 B1 * 6/2002 Goldman et al. ..... 175/39

(Continued)

FOREIGN PATENT DOCUMENTS

GB 2290330 12/1995
WO 9104500 4/1991

OTHER PUBLICATIONS

Gregory Mullen et al□□Planning and Field Validation of Annular Pressure Predictions□□AADE 01-NC-HO-08□□AADE National Drilling Technical Conference, Houston =, TX, Mar. 27-29, 2001.*
GL Bowers, "Pore Pressure Estimation from Velocity Data: Accounting for Overpressure Mechanisms besides Undercompaction," SPE Drilling & Completions, pp. 89-95 (Jun. 1995).

(Continued)

*Primary Examiner*—Kamini Shah
*Assistant Examiner*—Cuong V Luu

(57) ABSTRACT

A method, apparatus and system for predicting the formation pressure ahead of a bit in a well, which includes using measurements taken in shales and permeable formations at or near the bit together with centriod calculations to improve models predicting what the pressures ahead of the bit will be.

37 Claims, 4 Drawing Sheets

U.S. PATENT DOCUMENTS

| | | | | |
|---|---|---|---|---|
| 6,430,507 | B1 * | 8/2002 | Jorgensen et al. | 702/6 |
| 6,473,696 | B1 * | 10/2002 | Onyia et al. | 702/6 |
| 6,502,037 | B1 * | 12/2002 | Jorgensen et al. | 702/14 |
| 6,549,854 | B1 | 4/2003 | Malinverno et al. | |
| 6,751,558 | B2 * | 6/2004 | Huffman et al. | 702/14 |
| 6,792,354 | B1 * | 9/2004 | O'Meara, Jr. | 702/2 |
| 6,826,486 | B1 | 11/2004 | Malinverno | |
| 6,977,866 | B2 * | 12/2005 | Huffman et al. | 367/73 |
| 7,027,968 | B2 * | 4/2006 | Choe et al. | 703/10 |
| 2002/0013687 | A1 * | 1/2002 | Ortoleva | 703/10 |
| 2002/0120429 | A1 * | 8/2002 | Ortoleva | 703/2 |
| 2002/0139527 | A1 * | 10/2002 | Song et al. | 166/255.1 |
| 2003/0004648 | A1 * | 1/2003 | Huffman et al. | 702/14 |
| 2003/0139916 | A1 * | 7/2003 | Choe et al. | 703/10 |
| 2004/0141414 | A1 * | 7/2004 | Huffman et al. | 367/51 |
| 2005/0092483 | A1 * | 5/2005 | Vinegar et al. | 166/60 |
| 2005/0241855 | A1 * | 11/2005 | Wylie et al. | 175/45 |
| 2005/0284661 | A1 * | 12/2005 | Goldman et al. | 175/39 |
| 2006/0037781 | A1 * | 2/2006 | Leuchtenberg | 175/25 |

OTHER PUBLICATIONS

BA Eaton, "The Equation for Geopressure Prediction from Well Logs," SPE 5544, AIME, 50th Ann. Fall Mtg. Of SPE of AIME, Dallas, TX (Sep. 28-Oct. 1, 1975).

T. Finkbeiner, et al., "Stress, pore pressure, and dynamically constrained hydro-carbon columns in the South Eugen Island 330 field, northern Gulf of Mexico," AAPG Bulletin, vol. 85, No. 6, Jun. 2001, pp. 1007-1031.

M. Traugott, "Pore pressure and fracture pressure determinations in deepwater," Deepwater Technology Supplement to World Oil, Aug. 1997, pp. 1-8.

* cited by examiner

METHOD, APPARATUS AND SYSTEM FOR PORE PRESSURE PREDICTION IN PRESENCE OF DIPPING FORMATIONS

CROSS REFERENCE TO RELATED APPLICATIONS

This application claims priority under 35 U.S.C. § 119(e) of U.S. Provisional Application Ser. No. 60/371,541, filed Apr. 10, 2002, entitled "COUPLED SAND/SHALE MODEL FOR PORE PRESSURE PREDICTION IN THE PRESENCE OF DIPPING FORMATIONS," the contents of which is incorporated herein in its entirety by reference.

BACKGROUND OF THE INVENTION

1. Field of the Invention

This invention relates to methods and systems for use in pore pressure prediction in oil and gas exploration. In particular, the invention provides methods, apparatuses and systems for more effectively and efficiently predicting formation pore pressure.

2. Prior Art

An accurate knowledge of formation pore pressure is required for the safe and economic drilling of deepwater wells. Ideally, the weight of the mud in the well bore used to control formation pressures should only be slightly greater than the formation pressure. Too low a mud weight may allow formation fluids to enter the well bore which, in the worst case, could lead to loss of the well and damage at the surface and could endanger personnel at the surface of the well. Too high a mud weight will give too low a rate of penetration, increasing the cost of drilling the well, and could lead to fracturing of the formation and creating an underground blowout. Drilling is particularly hazardous in the presence of dipping permeable layers which can communicate from deeper formations into the well being drilled, resulting in pressures much higher than would be normally anticipated. In deep water offshore exploration, the deep water reduces the difference between the pore pressure and fracture-pressure and therefore requires the pore pressure to be predicted as accurately as possible. A pre-drill estimate of formation pore pressures can be created either by using offset wells directly, or by using such offset well to determine appropriate transform such as a seismic velocity to pore pressure transform, and then applying this transform to seismic velocities at the proposed well location. Examples of such transforms include the method of Eaton, which is described in "The Equation for Geopressure Prediction from Well Logs" SPE 5544 (Society of Petroleum Engineers of AIME, 1975), and that of Bowers, which is described in "Pore pressure estimation from velocity data. Accounting for pore-pressure mechanisms besides undercompaction," SPE Drilling and Completion (June 1995) 89-95, both incorporated herein by reference. As is known to those of skill in the art, other transforms (existing or to be developed in the future) may be used. These predictions can be updated while drilling the well, using Measurements While Drilling (MWD), Logging While Drilling (LWD), or other data obtained while drilling. Unfortunately, however, these methods only use-measurements for locations along the well trajectory, and thus ignore the effects of any property variations, such as velocity or pore pressure variation away from the well. This is particularly dangerous in the presence of dipping permeable beds, since these can communicate high overpressure at deeper depths away from the well to shallower depths at the well location, with the result that the pressures in the sands at the well location can be different from the pressures in the shale formations. This is illustrated in FIG. 1. Because sands, for example, are permeable, the variation of pore pressure with depth in the sands is given by the normal hydrostatic gradient of the fluid within the sand. Other permeable formations include limestone and dolomite. Although this application may discuss the invention in terms of sands, the invention also pertains to other permeable formations. Because they have low permeability, pore pressure in shale formations may increase with depth at a rate faster than the normal hydrostatic gradient. The pore pressure in the permeable formations and shales is only in equilibrium at one depth, the centroid. The concept of the centroid has been published. Some of the references are: "Pore Pressure and Fracture Pressure Determinations in Deepwater," Martin Traugott, Amoco E & P Technology, Houston, Tex., Deepwater Technology Supplement to *World Oil*, August 1997 and "*Stress, pore pressure, and dynamically constrained hydrocarbon columns in the South Eugene Island* 330*.eld, northern Gulf of Mexico*," Thomas Finkbeiner, Mark Zoback, Peter Flemings, and Beth Stump; AAPG Bulletin, v. 85, no. 6 (June 2001), pp. 1007-1031. Sands up-dip of the centroid have a higher pore pressure than the adjacent shales, which may lead to a kick while drilling, as the mud weight may be too low to hold the pressures of the sand formation in check. Sands down-dip of the centroid may be underpressured with respect to adjacent wells, leading to fluid loss into the sand while drilling as the mud weight may be higher than needed. It is generally preferable to drill high in a potential production formation, so wells frequently are be drilled into sand formations updip of the centroid.

FIG. 1 depicts a representation of the concept of a centriod. A well 10 is depicted schematically on the left side of FIG. 1 and pore pressures as a function of depth are depicted graphically on the right side of FIG. 1. In this example, the well 10 is being drilled of shore, as evidenced by a sea 15. The well 10 encounters overlying and underlying shale formations 20, 22 which have very little permeability, and a sand formation 25, which is permeable. (For simplification, only two shale formations 20, 22 and one sand formation 25 are depicted, with shale 20 overlying the sand 25 and shale 22 beneath the sand 25.) A curve depicting the hydrostatic gradient of the fluid within the sand, called the "normal hydrostatic pressure curve" 30, is plotted on the right side of FIG. 1 as a function of depth. A curve illustrating the pore pressure of the shale formations as a function of depth, called the "shale pore pressure curve" 35 herein, is depicted. The shale pore pressure curve 35 is drawn in FIG. 1 based on an assumption that the pressure in the shale formations 20, 22 is only a function of depth below mud line. This is an oversimplification and used for simplicity only. The actual pore pressure in the shales 20, 22 as a function of depth could be different and can be ascertained, as is known in the art, by other methods, such as an analysis of offset wells, seismic velocities or other techniques. Because shale formations are not permeable, the pressure in any given shale formation may be inconstant, with one point in a shale formation experiencing a pressure significantly different from that of second point in the same formation, if the depths of the first point and the second point are also significantly different.

A curve illustrating normal pore pressure in sand formations as a function of depth, called "normal sand pore pressure curve" 40 herein, is also depicted in FIG. 1. The intersection of the shale pore pressure curve 35 and the normal sand pore pressure curve 40, i.e. where the pressures of both curves 35 and 40 are equal, is found at the centroid 48. In other words, at the centroid the pressure in the overlying shale formation 20 is equal to the pressure in the sand formation 25.

Since the sand formation 25 is permeable, the pore pressures within the sand formation 25 will be fairly constant throughout the sand formation 25, that is, the pressure in the sand formation will be close to the pressure at the centroid 48, differing only by the hydrostatic gradient of the fluid created by the difference in the true vertical depth (TVD) of the point of interest in the sand formation 25 and the true vertical depth of the centroid 48. The well 10 is shown in FIG. 1 intersecting the sand 25 at a point updip of the centroid 48. Because the pore pressure in a sand formation updip of the centroid 48 is greater than the pressure in the adjacent shale formations 20,22, as the well passes through the sand interval 50, the well 10 will encounter pressures greater than would otherwise be expected from the pressure of the overlying shale 20. The pressure encountered by the well 10 in the sand 25 would be the pressure at the centroid 48, less the hydrostatic head of the fluid in the sand formation 25 from the TVD of the centroid (that is the pressure at point 55 on the normal hydrostatic pressure curve) to the TVD at which the well encounters the sand 25 (that is, the pressure at point 60 on the normal hydrostatic pressure curve).

Conversely, if the well 10 intersected the sand 25 down-dip of the centroid 48, the pore pressure in the sand would be the pressure a the centroid plus the additional hydrostatic head for difference in the well depth and the centroid depth and would be a lower pressure than the pressure the well would encounter in the shale formation 20. So the pressure in the sand downdip of the centroid will be slightly greater than the pressure at the centroid (but less than the pressure of the adjacent shale formations, while the pressure in the sand updip of the centroid will be less than the pressure at the centroid but greater than the pressure of the adjacent shales.

To phrase it in a different way, the pressure in the sand 25 at any particular depth can be determined. First determine the pressure in the shale formation 20 overlaying the sand 25 at the centroid location using any of the techniques available. At the centroid the pressure in the sand formation 25 will be equal to the pressure in the overlying shale formation 20. Then calculate the TVD difference between the top of the sand at the centroid and the top of the sand at the well location. The pressure in the sand at the well location then is given by pressure in the sand formation 25 at the centroid minus TVD hydrostatic gradient expressed in pounds per square inch (psi) or similar units. (Note that if the sand formation is downdip of the centriod, the TVD hydrostatic gradient difference will be a negative number, which when subtracted form the pressure at the centroid will yield a higher number than the pressure of the sand at the centroid.).

The shale pore pressure curve 35 illustrates formation pressures expected to be encountered in normally pressured shales and can be determined by using offset wells directly, or by using such an offset well to determine an appropriate transform, such as a seismic velocity to pore pressure transform. The centroid model was first introduced by Dickinson (1953) and was further elaborated by England et al. (1987) and Traugott and Heppard (1994), incorporated herein by reference. Although the centroid concept is well understood, there are no known techniques to use the centroid concept to predict the formation pressures in the sands ahead of the bit while drilling.

Thus the currently available approaches to predicting pore pressure available today have some important disadvantages, specifically they may not be accurate, especially in the presence of dipping permeable beds.

SUMMARY OF THE INVENTION

In view of the above problems, an object of the present invention is to provide methods, apparatuses and systems for predicting pore pressures anticipated to be encountered while eliminating or minimizing the impact of the problems and limitations described.

The present invention provides a method, apparatus and system for determining the formation pore pressures ahead of (i.e. deeper than) the bit, using a coupled sand shale model, even in overpressured environments in which dipping permeable beds are present. This invention accounts for the effects of dipping formations, and provides an improved look ahead prediction of formation pore pressure. This invention provides a technique for estimating the formation pressures in both sands and shales, ahead of the bit, while drilling the well. The invention provides a method for predicting the formation pressure ahead of a bit in a well, which includes the step of establishing a pore pressure model for shales expected to be encountered by the well and establishing a structural model for geology the well is expected to encounter. The step of establishing the pore pressure model for the shales may include the use of a transform, which may be a direct transform or an indirect transform, or may include the use of predictions from measurements or the use of well correlations. The step of establishing a structural model may include the use of well correlations, seismic interpretations, or multidimensional cross-sections. The method may further include calculating a pore pressure in a permeable formation expected to be encountered, determining a pressure in the permeable formation at the location the well is expected to encounter the permeable formation, obtaining measurements with a relationship to pore pressure while drilling the well, using the obtained measurements to update the pore pressure model for shales, and using the obtained measurements and the updated pore pressure model for shales to determine pressures in the permeable formation at the well location ahead of the bit. The step of calculating the pore pressure in the permeable formation may include, for example, using centroid computations, hydraulics modeling or basin modeling. The step of determining the pressure in the permeable formation at the location the well is expected to encounter the permeable formation may include, for example, using centroid computations, hydraulics model or basin modeling. The obtained measurements used to update the pore pressure model for shales may include for example seismic velocity measurements, interval transit time measurements, sonic velocity measurements, resistivity measurements, or density measurements.

The method of the invention may further include the steps of drilling into the permeable formation and calculating the pore pressure of the permeable formation, which may be done using APWD measurements as described herein or by directly measuring the pore pressure in the permeable formation or by using other observations along with simulations to compute pore pressure in the permeable formation. The method may further include re-calibrating the pore pressure in the permeable formation and recalibrating the structural model using the obtained measurements and the newly recalculated pore pressure of the permeable formation and may further include using a hydrostatic gradient to re-calculate the pore pressure of the permeable formation at the centroid location. It may further include the steps of setting a pore pressure, at the centroid, of a shale overlying the permeable formation equal to the re-calculated pore pressure of the permeable formation in the centroid location, and then using the pore pressure at the centroid of the shale overlying the permeable formation to update the pore pressure model of the shales. In a preferred embodiment of the invention, the permeable formation is a sand. The invention also provides for a program storage device readable by a machine, tangibly embodying a program of instructions executable by the machine, to perform method steps for predicting a formation pressure ahead of a bit in a well, including establishing a pore pressure model for shales expected to be encountered by the well, establishing a structural model for geology the well is expected to encounter; calculating a pore pressure in a permeable formation expected to be encountered, determining a pressure in the permeable formation at the location the well is expected to encounter the permeable formation, obtaining measurements with a relationship to pore pressure while drilling the well, using the obtained measurements to update the pore pressure model for shales, and using the obtained measurements and the updated pore pressure model for shales to determine pressures in the permeable formation at the well location ahead of the bit. The step of establishing the pore pressure model for the shales may include the use of a transform, which may be a direct transform or an indirect transform, or may include use of predictions from measurements or the use of well correlations. The step of establishing a structural model may include the use of well correlations, seismic interpretations, or multi-dimensional cross-sections. The step of calculating of calculating the pore pressure in the permeable formation may include, for example, using centroid computations, hydraulics modeling or basin modeling. The step of determining the pressure in the permeable formation at the location the well is expected to encounter the permeable formation may include, for example, using centroid computations, hydraulics model or basin modeling. The obtained measurements used to update the pore pressure model for shales may include, for example, seismic velocity measurements, interval transit time measurements, sonic velocity measurements, resistivity measurements, or density measurements.

The program of instructions for the program storage device of the present invention may also include the steps of drilling into the permeable formation, and calculating the pore pressure of the permeable formation. Calculating the pore pressure of the permeable formation may include using APWD measurements, as described further herein, or by directly measuring the pore pressure in the permeable formation or by using other observations along with simulations to compute pore pressure in the permeable formation.

The program of instructions for the program storage device of the present invention may also include the steps of re-calibrating the pore pressure in the permeable formation and recalibrating the structural model using the obtained measurements and the newly re-calculated pore pressure of the permeable formation and may further include using a hydrostatic gradient to re-calculate the pore pressure of the permeable formation at the centroid location. It may further include the steps of setting a pore pressure, at the centroid, of a shale overlying the permeable formation equal to the re-calculated pore pressure of the permeable formation in the centroid location, and then using the pore pressure at the centroid of the shale overlying the permeable formation to update the pore pressure model of the shales.

The present invention also provides for a system for predicting a formation pressure ahead of a bit in a well, including an apparatus adapted for establishing a pore pressure model for shales expected to be encountered by the well, an apparatus adapted for establishing a structural model for geology the well is expected to encounter; an apparatus adapted for calculating a pore pressure in a permeable formation expected to be encountered, an apparatus adapted for determining a pressure in the permeable formation at the location the well is expected to encounter the permeable formation, an apparatus adapted for obtaining measurements with a relationship to pore pressure while drilling the well, an apparatus adapted for using the obtained measurements to update the pore pressure model for shales, and an apparatus adapted for using the obtained measurements and the updated pore pressure model for shales to determine pressures in the permeable formation at the well location ahead of the bit.

The system of the present invention may further include an apparatus adapted for drilling into the permeable formation, and an apparatus adapted for calculating the pore pressure of the permeable formation. The apparatus adapted for calculating the pore pressure of the permeable formation may use APWD measurements, as described further herein or by directly measuring the pore pressure in the permeable formation or by using other observations along with simulations to compute pore pressure in the permeable formation.

The system of the present invention may also include an apparatus adapted for re-calibrating the pore pressure in the permeable formation and recalibrating the structural model using the obtained measurements and results of the calculation performed by the apparatus adapted for calculating the pore pressure of the permeable formation, an apparatus adapted for using a hydrostatic gradient to re-calculate the pore pressure of the permeable formation at the centroid location and set a pore pressure, at the centroid, of a shale overlying the permeable formation equal to the re-calculated pore pressure of the permeable formation in the centroid location; and an apparatus adapted for using the pore pressure at the centroid of the shale overlying the permeable formation to update the pore pressure model of the shales. In a system of the invention, the apparatus adapted for establishing the pore pressure model for shales may be specifically adapted to include the use of a transform, which may be a direct or indirect transform, or may be adapted to include use of predictions from measurements or the use of well correlations. The apparatus adapted for establishing a structural model may be adapted to use well correlations, seismic interpretations, or multi-dimensional cross-sections. The apparatus adapted for calculating the pore pressure in the permeable formation may be adapted to use, for example, centroid computations, hydraulics modeling or basin modeling. The apparatus adapted for determining the pressure in the permeable formation at the location the well is expected to encounter the permeable formation may be adapted to use, for example, centroid computations, hydraulics model or basin modeling. The obtained measurements used to update the pore pressure model for shales may include for example seismic velocity measurements, interval transit time measurements, sonic velocity measurements, resistivity measurements, or density measurements.

The invention also provides a method for predicting the formation pressure ahead of a bit in a well, which includes using measurements taken in shales and permeable formations at or near the bit together with centroid calculations to improve models predicting what the pressures ahead of the bit will be.

Other objects, features and advantages of the present invention will become apparent to those of skill in art by reference to the figures, the description that follows and the claims.

DETAILED DESCRIPTION OF THE DRAWINGS

In the following detailed description of the preferred embodiments and other embodiments of the invention, reference is made to the accompanying drawings. It is to be understood that those of skill in the art will readily see other embodiments and changes may be made without departing from the scope of the invention.

Figure 1:
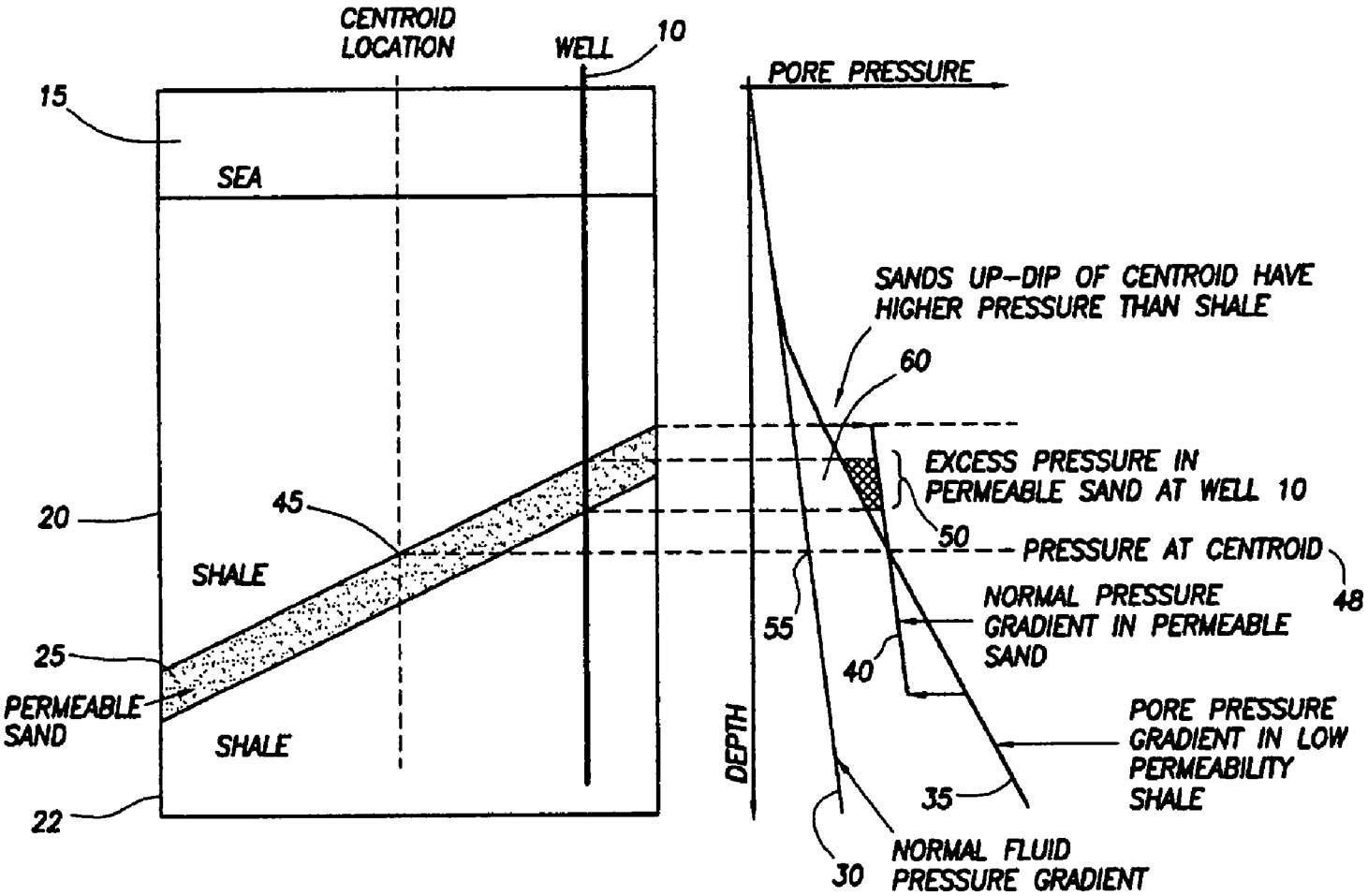
FIG. 1 (Prior Art)
FIG. 1 is a schematic illustrating the prior art centroid concept.

FIG. 1 illustrates an example of the centroid concept, as described in the prior art section herein.

Figure 2:
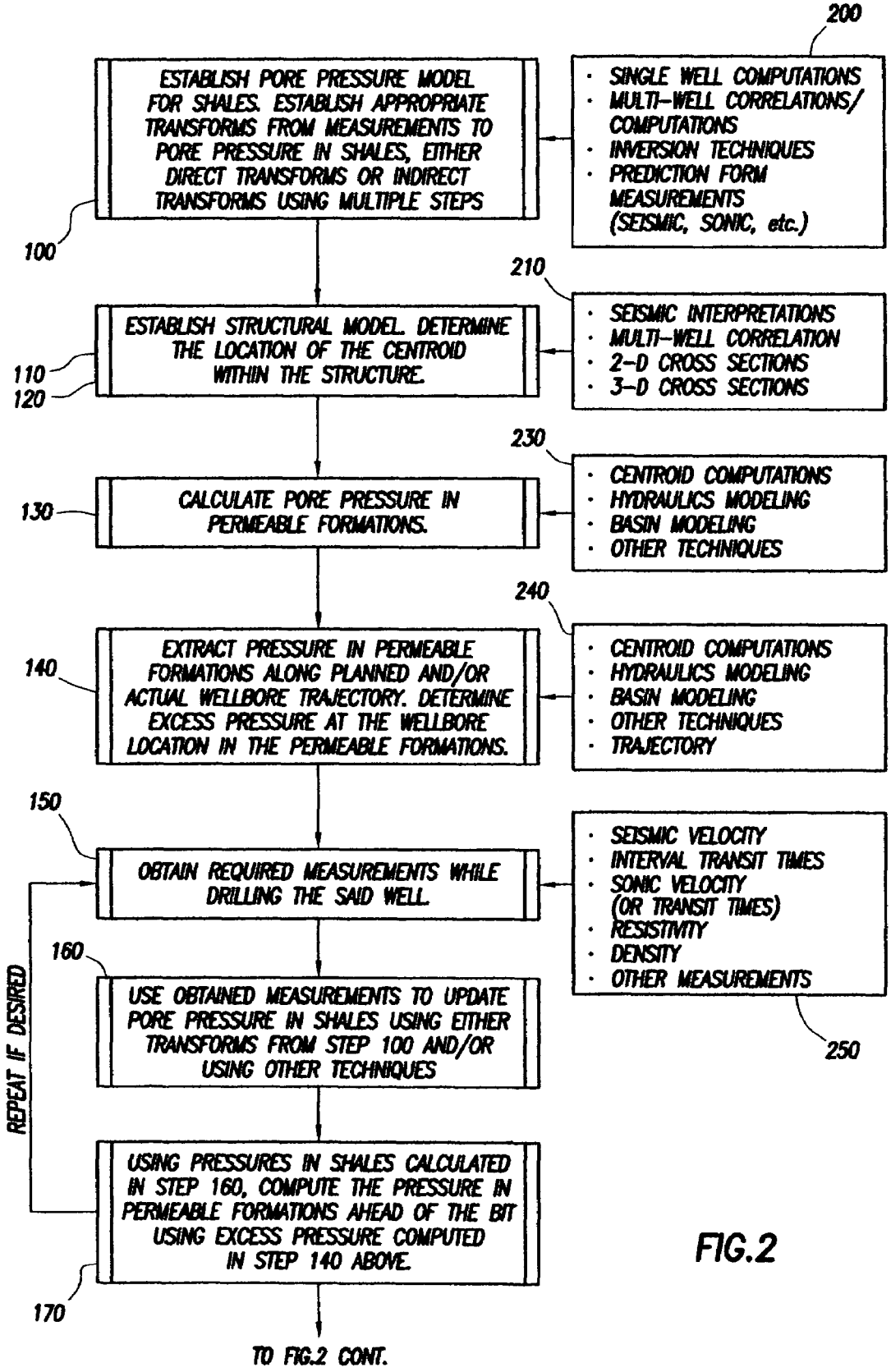
FIG. 2 is a flowchart of a preferred embodiment of the present invention
Figure 2:
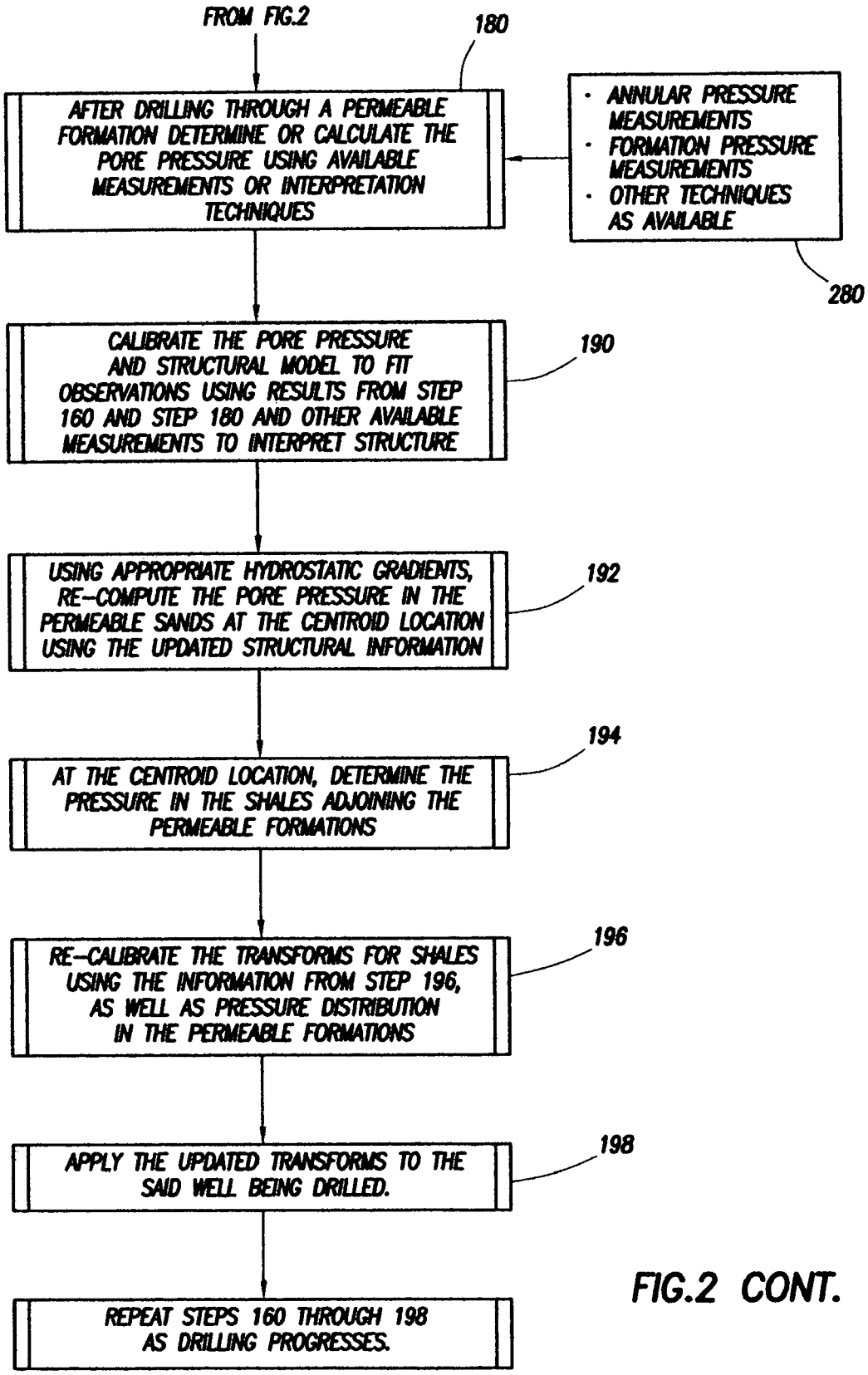

FIG. 2 depicts a flowchart illustrating a preferred embodiment of the present invention. This preferred embodiment of the present invention starts with establishing (100) a pore pressure model for the shale formations anticipated to be encountered while drilling the well, using any of the available techniques. For example, as indicated in FIG. 2 by box 200, the pore pressure in the shale formations may be predicted using single well correlations, multiple well correlations or computations, inversion techniques or by predictions from measurements such as seismic or sonic or other measurements of formation parameters. In the preferred embodiment of FIG. 2, step 100 includes establishing transforms from (pre-drilling) measurements to pore pressure in the shales. If, as in this preferred embodiment, transforms are used, the transforms may be direct transforms or indirect transforms involving multiple steps. Other methods for establishing the pore pressure model for shales may be used in other embodiments of the invention. The next step is to establish 110 a structural model. The structural model is a model of the geological formations the well is anticipated to encounter and may be a simple two-dimensional model or a more advanced three-dimensional model. The structural model may be established independently of step 100. As indicated by box 210, the establishment 110 of the structural model may be based on using seismic interpretations, multiple well correlations, two-dimensional cross sections, three-dimensional cross sections or other techniques known in the art. After establishing 110 the structural model, the structural model is used to determine 120 the location of the centroid within a permeable formation of interest, such as a sand, as is known by those of skill in the art.

After determining 120 the location of the centroid, the anticipated pressure in the permeable formation of interest is computed (130). This can be done as indicated by box 230 by using centroid calculations (as described in the prior art section herein), hydraulics modeling or basin modeling to name of few of the techniques known to those of skill in the art. As other techniques for determining this pressure become known, they may be used in this step. The determination of pore pressure in the permeable formation 130 may be computed in the entire permeable formation or at specific locations within the permeable formation such as the centroid and the well location. Once the pressure distribution in the permeable formation is determined, the next step is to compute 140 the pressure in the permeable formation at the location where the well is expected to encounter the permeable formation. If the well is to encounter the permeable formation updip of the centroid, the pressure so determined will be in excess of that which would be expected considering the pressure in the overlying shale formation, so this step would involve determining an excess pressure.

If the well were to be drilled so that the well encountered the permeable formation downdip of the centrum, the pressure in the permeable formation at the well location would be less that would be anticipated by the overlying shale formation; that is, the permeable formation would be underpressured. If the permeable formation did not dip at all, the pressures throughout the permeable formation would be equal to the pressure of the overlying shale, which would also not dip and thus would lie at unvarying depth. While the invention includes determining the pressure difference, if any, between the permeable formation and its overlying shale at different locations, the invention is particularly useful in highly dipped permeable formations, where this pressure difference is great.

The excess pressure between the permeable formation and its overlying shale at the well location is determined in step 140 in the preferred embodiment of FIG. 2. Determining the pressure in the permeable formation at the well location may be made as indicated in Box 240 by using centroid calculations, hydraulics modeling, basin modeling or trajectory techniques to name of few of the techniques known to those of skill in the art.

While drilling the well, the next step is to obtain (150) measurements, either in real-time using measurements while drilling (MWD), logging while drilling (LWD), VSP or by other means at selected intervals. The measurements may be taken by using sensors placed either on surface or downhole or may result from computations based on some of these measurements, such as d exponent computations. As indicated by box 250, these measurements may be seismic velocity measurements, interval travel times, sonic velocity measurements, resistivity measurements, formation density measurements, or other measurements such as "d" exponent, to name a few that can be used to reflect pore pressure. The measurements obtained will be indicative of the pore pressure that the well encounters as it is being drilled. The obtained measurements are then used 160 to update the pore pressures in shale formations through which the well is drilled, using any of the known techniques and will be determined for shale formations close to the bit. Although the pore pressure model for shale formations established in step 100 predicted the pressures to be encountered in shale formations, the updated pore pressures will be more accurate. For example, if a seismic velocity to pore pressure transform was established as part of step 100, the seismic velocity to pore pressure transform may be updated using pore pressure information for shale formations acquired while drilling. The updated transform also gives prediction of the pressure in the shales ahead of the bit, by applying this transform to seismic velocity or other measurements available ahead of (deeper than) the bit. In the next step, the obtained measurements from step 150, and the estimation of the pore pressure in the shale formations ahead of the bit from step 160 are used to determine 170 the pressures in the permeable formation at the well location ahead of the bit. This may be accomplished by adding the excess pressure determined in step 140 to the updated pore pressure predicted for the shale overlying the permeable formation. As the well continues to be drilled, steps 150 through 170 may be repeated for more accurate pore pressure prediction until the first permeable formation of interest is reached.

Figure 4:
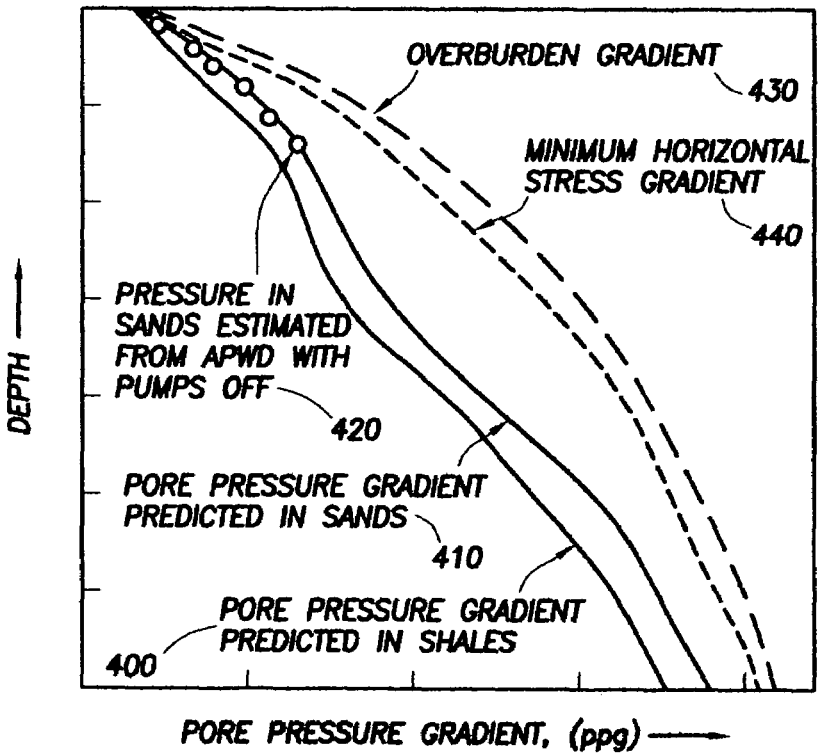
FIG. 4 is a graph of depth versus pore pressure gradient using a preferred embodiment of the present invention.

Once the permeable formation is drilled, other techniques are used in this preferred embodiment of the invention to measure 180 the actual pressure in the permeable formation. One such technique of measuring 180 the pore pressure in the permeable formation is to use the Annular Pressure While Drilling (APWD) measurement to determine the pore pressure in permeable formations. This is shown in FIG. 4, described further below. As shown in box 280, in addition to the Annular Pressure While Drilling measurements, other methods include direct formation pressure measurements, such as Schlumberger's RFT™ wireline tool, or any method that might be developed to take direct measurements of the pore pressure of the permeable formation while drilling or using other observations along with simulations to compute pore pressure in the permeable formation.

The next step is to use the results of steps 160 and 180 to calibrate 190 the pore pressure for the permeable formation and for the structural model so that the pore pressure for the permeable formation and the structural model fit the results of the observations of steps 160 and 180.

In the next step, using the updated 190 structural model, the pore pressure obtained 180 after drilling through the permeable formation and the hydrostatic gradient for fluids in the permeable formation, re-compute 192 the pore pressure in the permeable formation at the centroid location. Since the pore pressure in permeable formation and the pore pressure in the permeable formation's overlying shale at the centroid are equal, in the next step, re-determine 194 the pore pressure of the overlying shale formation at the centroid, which will be equal to the pore pressure in the permeable formation at the centroid location computed in step 192. Using the re-determined 194 pore pressure of the overlying shale formation, re-calibrate 196 the transforms for shales which were determined in step 100. For example, if a velocity to pore pressure transform was used, recalibrate the velocity to pore pressure transform using the updated pore pressure of the shale at the centroid. The next step is to apply 198 the transforms to the well being drilled to determine pressures the well may encounter at depths yet to be drilled. Wells may be drilled with the intention of hitting two or more permeable formations. Steps 40 through 198 can then be repeated as necessary as the well continues to be drilled, so pore pressure is updated frequently for more accurate predictions of the pressure that will be encountered in sands and permeable formations ahead of the bit.

Figure 3:
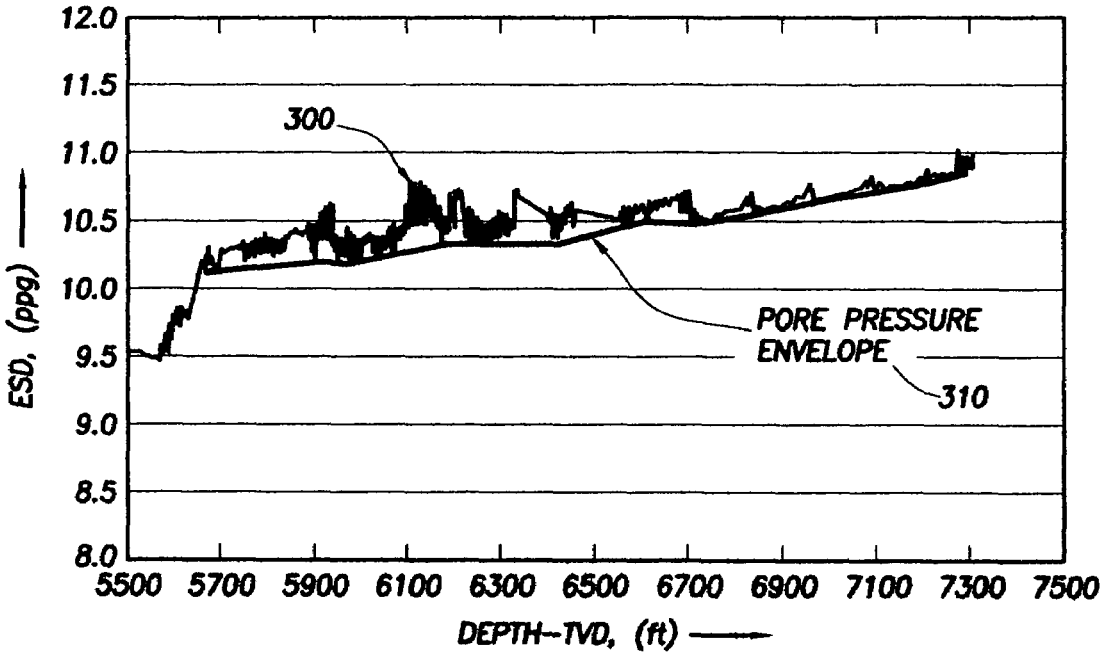
FIG. 3 is a graph illustrating a method of using Annular Pressure While Drilling (APWD) measurements to determine the pore pressure in sands.

FIG. 3 depicts a graph of pressure versus depth. Annular Pressure While Drilling (APWD) measurements 400 are plotted on the graph in FIG. 3 to determine the pore pressure in sands. The pore pressure envelope curve 410 is also plotted in FIG. 3. The APWD measurements 400 can be used in step 180 in the flow-chart of the preferred embodiment of the present invention depicted in FIG. 2 to determine the pore pressures in the permeable formations. As is known to those of skill in the art, the APWD measures pressure both while pumping and while the pumps are off. When the pumps are ON the downhole pressures are higher due to frictional losses. In FIG. 3, the APWD measurements 300 taken while the pumps are off are plotted. When the pumps are off the pressure in the well drops until an equilibrium is reached with the formation pressure. Based on this relationship, the pore pressure 310 for the sand formation can be plotted as illustrated in FIG. 3. FIG. 4 illustrates pressure curves that can be developed using a preferred embodiment of the present invention. For simplicity, they are correlated to the preferred embodiment of invention as illustrated in FIG. 2. The curve 400 for the pore pressure gradient predicted in shales is an example of the pore pressure model for shales established using the invention, such as that established in step 100 of FIG. 2. The curve 410 for pore pressure gradient predicted in sands is an example of the pore pressures anticipated in sands as extracted in step 140 of FIG. 2. The dots 420 plotted along curve 410 indicate pressure measurements for sand formations taken from APWD measurements (as shown in FIG. 3) with the pumps off. In this particular example, the predicted sand pressures 410 correlate closely with the dots 420 indicating pressures taken from the APWD measurements, which means the predicted pressures 410 were fairly accurate (at least up until the last depth where the measurements 420 were taken. As the well is drilled and the procedure of the invention is followed, curves 400 and 410 would be re-calibrated and redrawn, as described in the discussion of FIG. 2 herein. For simplicity, FIG. 4 does not show the pre-drill and the updated pressure predictions in shales and sands as described in the discussion of FIG. 2. FIG. 4 also illustrates an overburden gradient curve 430 and a minimum horizontal stress gradient 440, which are familiar to those of skill in the art.

Although the foregoing is provided for purposes of illustrating, explaining and describing certain embodiments of the invention in particular detail, modifications and adaptations to the described methods, systems and other embodiments will be apparent to those skilled in the art and may be made without departing from the scope or spirit of the invention.

What is claimed is:

1. A method for predicting the formation pressure ahead of a bit in a well, comprising:

a) establishing a pore pressure model for shales expected to be encountered by the well, b) establishing a structural model for geology the well is expected to encounter;

c) measuring a pressure in a first permeable formation at the location where the well encounters the permeable formation, d) using the measured pressure in the first permeable formation to update the pore pressure model for shales; and e) using the structural model and the updated pore pressure model for shales to predict pressures in a second permeable formation at the well location ahead of the bit.

2. The method of claim 1 further comprising: drilling into the second permeable formation and determining the pore pressure of the second permeable formation.

3. The method of claim 2 wherein the determining includes using APWD measurements.

4. The method of claim 1, wherein the step d) using the measured pressure in the first permeable formation to update the pore pressure model for shales comprises:

using a hydrostatic gradient, calculate the pore pressure of the first permeable formation, at the centroid location and set a pore pressure at the centroid of a shale neighboring the first permeable formation equal to the calculated pore pressure of the first permeable formation at the centroid location; and using the pore pressure at the centroid of the shale neighboring the first permeable formation to update the pore pressure model of the shales.

5. The method of claim 1 wherein the first permeable formation is a sand.

6. The method of claim 1 wherein step (a) of establishing the pore pressure model for shales includes the use of a transform.

7. The method of claim 1 wherein step (a) of establishing the pore pressure model for shales includes the use of well correlations.

8. The method of claim 1 wherein step (a) of establishing the pore pressure model for shales includes the use of predictions from previously acquired measurements.

9. The method of claim 1 wherein the step (b) of establishing the structural model includes using seismic interpretations.

10. The method of claim 1 wherein the step (b) of establishing the structural model includes using well correlation.

11. The method of claim 1 wherein the step (b) of establishing the structural model includes two-dimensional cross sections.

12. The method of claim 1 wherein the step (b) of establishing the structural model includes three-dimensional cross sections.

13. A method for predicting the formation pressure ahead of a bit in a well, comprising:

a) establishing a pore pressure model for shales and a structural model for geology expected to be encountered by the well;

b) measuring a pressure in a first permeable formation while drilling;

c) using the measured pressure in the first permeable formation to improve the pore pressure model for shales;

d) determining a pore pressure at a centroid location based on the pore pressure model and the structural model; and e) predicting, based on the pore pressure at the centroid location, pore pressures in a second permeable formation ahead of the bit.

14. A program storage device readable by a computer, tangibly embodying a program of instructions executable by the computer, to perform method steps for predicting a formation pressure ahead of a bit in a well, the method steps comprising:

a) establishing a pore pressure model for shales expected to be encountered by the well, b) establishing a structural model for geology the well is expected to encounter;

c) measuring a pressure in a first permeable formation while drilling the well, d) using the measured pressure in the first permeable formation to update the pore pressure model for shales; and e) using the structural model and the updated pore pressure model for shales to predict pressures in a second permeable formation at the well location ahead of the bit.

15. The program storage device of claim 14 further comprising: drilling into the second permeable formation and determining the pore pressure of the second permeable formation.

16. The program storage device of claim 15 wherein the determining includes using APWD measurements.

17. The program storage device of claim 15, the method steps further comprising:

using a hydrostatic gradient, calculating the pore pressure of the first permeable formation, at the centroid location and set a pore pressure at the centroid of a shale neighboring the first permeable formation equal to the calculated pore pressure of the first permeable formation at the centroid location; and using the pore pressure at the centroid of the shale neighboring the first permeable formation to update the pore pressure model of the shales.

18. The program storage device of claim 14 wherein the first permeable formation is a sand.

19. The program storage device of claim 14, wherein step (a) of establishing the pore pressure model for shales includes the use of a transform.

20. The program storage device of claim 14, wherein step (a) of establishing the pore pressure model for shales includes the use of well correlations.

21. The program storage device of claim 14, wherein step (a) of establishing the pore pressure model for shales includes the use of predictions from previously acquired measurements.

22. The program storage device of claim 14, wherein the step (b) of establishing the structural model includes using seismic interpretations.

23. The program storage device of claim 14, wherein the step (b) of establishing the structural model includes using well correlation.

24. The program storage device of claim 14, wherein the step (b) of establishing the structural model includes two-dimensional cross sections.

25. The program storage device of claim 14, wherein the step (b) of establishing the structural model includes three-dimensional cross sections.

26. A system for predicting the formation pressure ahead of a bit in a well, comprising:

a) apparatus adapted for establishing a pore pressure model for shales expected to be encountered by the well, b) apparatus adapted for establishing a structural model for geology the well is expected to encounter;

c) apparatus adapted for measuring a pressure in a first permeable formation while drilling the well;

d) apparatus adapted for using the measured pressure in the first permeable formation to update the pore pressure model for shales; and e) apparatus adapted for using the structural model and the updated pore pressure model for shales to predict pressures in a second permeable formation at the well location ahead of the bit.

27. The system of claim 26 further comprising:

apparatus adapted for determining the pore pressure of the second permeable formation.

28. The system of claim 27 wherein the determining performed by the apparatus adapted for determining the pore pressure of the second permeable formation uses APWD measurements.

29. The system of claim 27 further comprising:

apparatus adapted for using a hydrostatic gradient to calculate the pore pressure of the first permeable formation, at the centroid location and set a pore pressure at the centroid of a shale neighboring the first permeable formation equal to the calculated pore pressure of the first permeable formation at the centroid location; and apparatus adapted for using the pore pressure at the centroid of the shale neighboring the first permeable formation to update the pore pressure model of the shales.

30. The system of claim 26, wherein the first permeable formation is a sand.

31. The system of claim 26, wherein the apparatus adapted for establishing the pore pressure model for shales includes the use of a transform.

32. The system of claim 26, wherein the apparatus adapted for establishing the pore pressure model for shales includes the use of well correlations.

33. The system of claim 26, wherein the apparatus adapted for establishing the pore pressure model for shales includes the use of predictions from previously acquired measurements.

34. The system of claim 26, wherein the apparatus adapted for establishing the structural model includes using seismic interpretations.

35. The system of claim 26, wherein the apparatus adapted for establishing the structural model includes using well correlation.

36. The system of claim 26, wherein the apparatus adapted for establishing the structural model includes two-dimensional cross sections.

37. The system of claim 26, wherein the apparatus adapted for establishing the structural model includes three-dimensional cross sections.

* * * * *